United States Patent [19]

Dameret et al.

[11] 4,311,155

[45] Jan. 19, 1982

[54] PROCESS AND DEVICE FOR CUTTING OUT CIGAR WRAPPERS FROM A TOBACCO LEAF

[75] Inventors: Jean-Louis Dameret; Jacques Maximilien; Jacques Paret, all of Fleury-les-Aubrais, France

[73] Assignee: Service d'Exploitation Industrielle des Tabacs et des Allumettes, Paris, France

[21] Appl. No.: 66,391

[22] Filed: Aug. 14, 1979

[30] Foreign Application Priority Data

Aug. 18, 1978 [FR] France ..... 78 24112

[51] Int. Cl.[3] ..... A24B 7/14

[52] U.S. Cl. ..... 131/280; 131/33

[58] Field of Search ..... 131/15 R, 15 A, 15 B, 131/15 C, 16, 20 R, 21 R, 33; 356/239

[56] References Cited

U.S. PATENT DOCUMENTS 4,205,914 6/1980 Anderson et al. ..... 356/431

FOREIGN PATENT DOCUMENTS 2019074 9/1969 France .

*Primary Examiner*—Robert W. Michell
*Assistant Examiner*—T. J. Wallen
*Attorney, Agent, or Firm*—Sandler & Greenblum

[57] ABSTRACT

The process comprises the step of determining the coordinates of each wrapper to be cut out, allocating a cut-out tool to each wrapper, displacing each of the tools individually to bring them all into similar relative starting positions, and simultaneously displacing the tools along identical paths. Each tool is fixed to a lever pivotally mounted on a rotary shaft perpendicular to respective wrappers, a connecting rod being pivotally mounted on the shaft and the lever.

5 Claims, 4 Drawing Figures

PROCESS AND DEVICE FOR CUTTING OUT CIGAR WRAPPERS FROM A TOBACCO LEAF

BACKGROUND OF THE INVENTION

1. Technical Field of the Invention

The present invention relates to a process and a device for enabling a plurality of cigar wrappers to be cut out simultaneously from a leaf or half-leaf of tobacco.

2. Discussion of the Prior Art

Processes for simultaneously cutting out from a given surface a plurality of elements having identical predetermined contours are already known from the prior art and are widely used at present. The means used are generally mechanical means shaped to have the same profile as that of the elements to be cut out. They may also be more precise means, but also more delicate ones, such as the water jets or lasers. However, in any case, the technical problem to be solved is relatively simple, as the surface from which the elements are to be cut out may be used entirely. Therefore there is no need to modify the plane of cut from one simultaneous cut-out to the following simultaneous cut-out.

The problem is much more complex in the field of tobacco where the surfaces to be cut out are plant leaves, none of which resembles another: they differ not only by their size and outer shape, but also by the position of the ribs and possible defects, the quality of the parenchyma, etc. It is therefore obvious that, from one leaf to another, and even from one half-leaf to the other half of the same leaf, the possible number and arrangement of wrappers to be cut out differs. A new plane of cut must therefore be provided and adjusted as a function of the particularities of each half-leaf.

In response to this technical problem, mechanical means have already been used where the cut-out tools have the same profile as that of the wrappers to be cut out. To obtain a simultaneous cut-out of a plurality of wrappers from a half-leaf, it has sufficed, after the cut-out tools were subjected to a new arrangement in spaced adapted to the geography of the half-leaf, to place the tools in contact with the half-leaf, or place the half-leaf in contact with the tools.

However, the technical problem has not yet been solved if another type of cut-out tool is used: e.g., tools such as water jets or lasers which must exactly follow the profile of the wrappers to be cut out.

In the case of such tools, it could well be imagined to actuate each separately.

This modus operandi is very simple; however, its realisation would lead to an unnecessarily complex and uneconomical device, as it does not take into account the fact that the contour of the wrappers to be cut out simultaneously are identical.

Another aspect of the problem resides in the necessity of coordinating the different operations, both in space and in time. The coordination in time implies that, for all of the wrappers cut from a leaf or a half-leaf, the cutting process must begin at the same time and end at the same time, without any time lag.

The coordination in space is also necessary, as two tools which cut out two wrappers tangential to each other must avoid obstructing each other.

SUMMARY OF THE INVENTION

The process according to the invention responds to this need for economic and coordinated action of the cutting tools. It consists in determining the position or profile of each wrapper to be cut out from the leaf or half-leaf, in allocating to each wrapper a cut-out tool, in individually displacing each of the tools to bring them all into the same relative starting position with respect to the contours of the respective wrappers, and simultaneously displacing the tools along the same path. The tools are displaced along identical paths in order to achieve the simultaneous cutting of a plurality of wrappers which are identical in both size and shape.

As the disposition and number of wrappers vary from one half-leaf to another, the tools must be adapted to the particularities of each half-leaf: the starting position for cutting are different for each tool and each half-leaf; the displacements of the tools must therefore be individualised.

Once positioned at the starting point for cut-out, all of the tools may be displaced by means of a common control, it being given that the contours of the wrappers to be cut out are identical. Of course, this is possible only if the relative starting position of each tool with respect to the contour of the wrapper that it will cut out is the same for all the tools.

The positioning of each tool is effected as a function of the position of each wrapper in the half-leaf.

To determine the position or profile of each wrapper, account is taken both of its center coordinates, which represent the point of intersection of the two main axes of said wrapper, i.e., the longitudinal axis and the transverse axis, and of its orientation, i.e., the angle made by its longitudinal axis with the longitudinal axis of the half-leaf.

Once each tool has been allocated to a respective wrapper and has been positioned with respect to the centre of this wrapper, it must then be placed in starting position, so that the starting point for each tool is the same for each respective wrapper.

The outline or path followed by the tools will then be the same for all, hence the possibility of using a single control for all of the tools.

This is also important as it enables the risks of obstruction which might otherwise result between two adjacent tools in the zone of proximity or tangency of the contours of two wrappers to be avoided, or at least to be limited.

In order to avoid or limit any mutual obstruction of the tools, which would be due to the fact that two adjacent wrappers are very close to each other, or even tangential, it is provided that, after having positioned each tool with respect to the centre of the wrapper, the subsequent displacements of the tool up to the starting cutting points are inscribed in a cylinder which has as its directrix the outer contour of a wrapper.

The starting point for cutting will advantageously be one of the points of intersection of a main axis of the wrapper with the contour thereof. These are points which are easily locatable on the contour of the wrappers. One of the points of intersection of the transverse axis of the wrapper with the contour thereof will preferably be chosen as starting point; these points are closest to the centre of the wrapper, and therefore require less displacement of the tool to reach the starting position.

BRIEF DESCRIPTION OF THE DRAWINGS

The invention will be more readily understood after reading the following description with reference to the accompanying drawings, in which:

Referring now to a drawings, FIG. 1 shows the possible diagram of a device for treating whole leaves. On both sides of the central rib of the leaf are disposed a number (n) of cut-out units (6 in the present case). Each of these units comprises a support column 1 which abuts against a frame (not shown), a horizontal arm 2 adapted to come above the tobacco leaf to be cut out and a cut-out head 3 which is carried by the arm 2 and which supports and controls the cut-out tool (not shown). The displacement of the cutout heads and the cut-out tools is controlled by motors which receive orders from a computer. This computer possesses all the necessary data relative to the cut-outs to be made.

Figure 1:
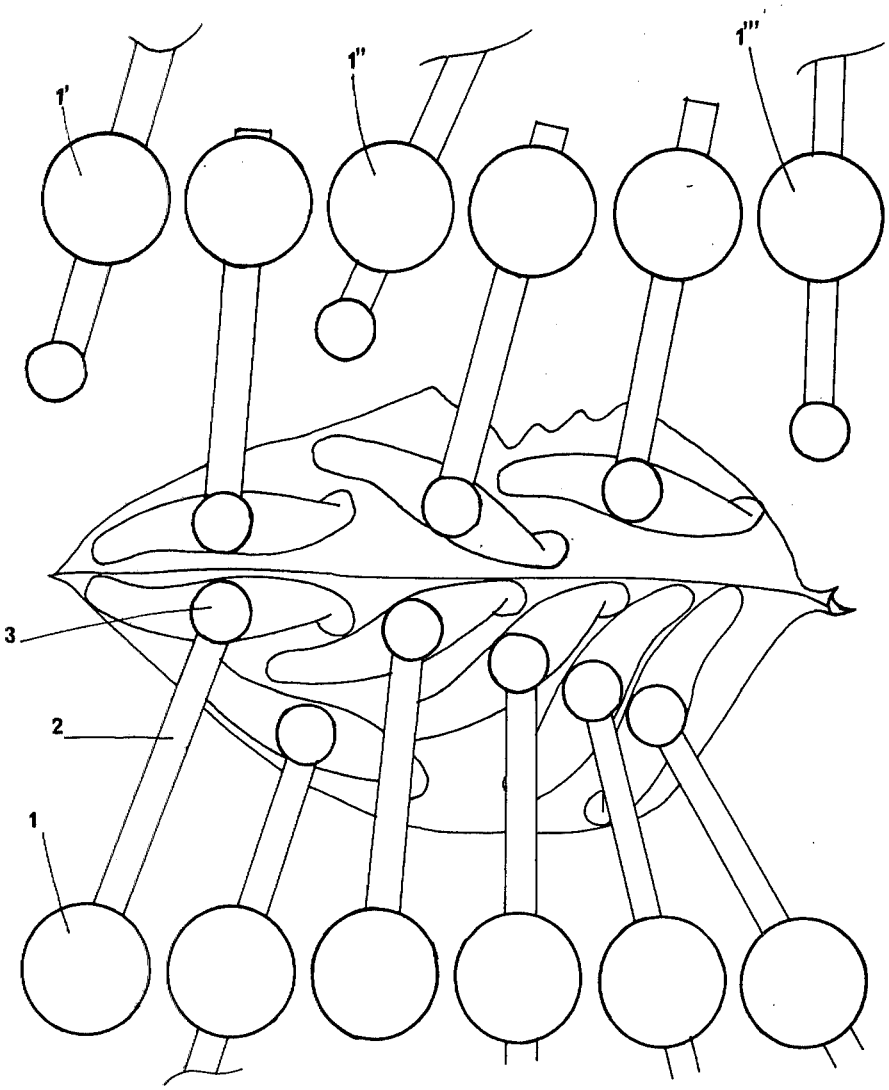
FIG. 1 shows a schematic view of a device for cutting out wrappers from whole leaves.

It is seen that, according to the dimensions and state of the half-leaf in question, a variable number of wrappers may be cut-out therefrom: whilst in the right-hand half-leaf only three whole wrappers may be cut out, three cut-out units 1', 1'', 1''' then remaining unused, six may be cut out from the left-hand half-leaf. The arm and the column are mobile with respect to each other: either the arm is telescopic on the support column, which is fixed, or the arm is fixedly mounted on a mobile column. In both cases, the column pivots about its vertical axis. In the example shown in FIG. 1, the column is fixed and the arm is mobile. The cut-out heads 3 are already positioned above the wrappers to be cut out.

The cut-out heads used in the embodiment set forth hereinbelow and illustrated in FIGS. 2, 3 and 4, each employ a water jet as the cut-out tool.

The cut-out head 3 is disposed between the arm 2 and the surface or leaf S to be cutout and perpendicular to both. It comprises an inlet tube 4 for water under very high pressure, a lever 5 at the free end of which is fixed a tool or nozzle 6 and a shaft rotatably mounted on an axis 10 which passes therethrough. The lever is articulated by its end opposite the nozzle 6 at a point 7 and may pivot about an axis perpendicular to the axis 10 of the cut-out head.

The lever 5 is also connected at a point 8 to a connecting rod 11 which is articulated by its end 9.

The point of articulation 9 of the connecting rod 11 is fixed, whilst the articulation point 7 of the lever 5 is mounted to move along the axis 10 by known means (not shown).

These means may comprise a cam and cam follower system, the profile of the cam being a function of the contour of the wrapper to be cut out, and a transmission mechanism, for example a rack and pinion type mechanism.

The movement of rotation of the shaft of the cut-out head 3 about the axis 10 is also obtained by known means, such as a set of bevel gears (not shown).

Figure 2:
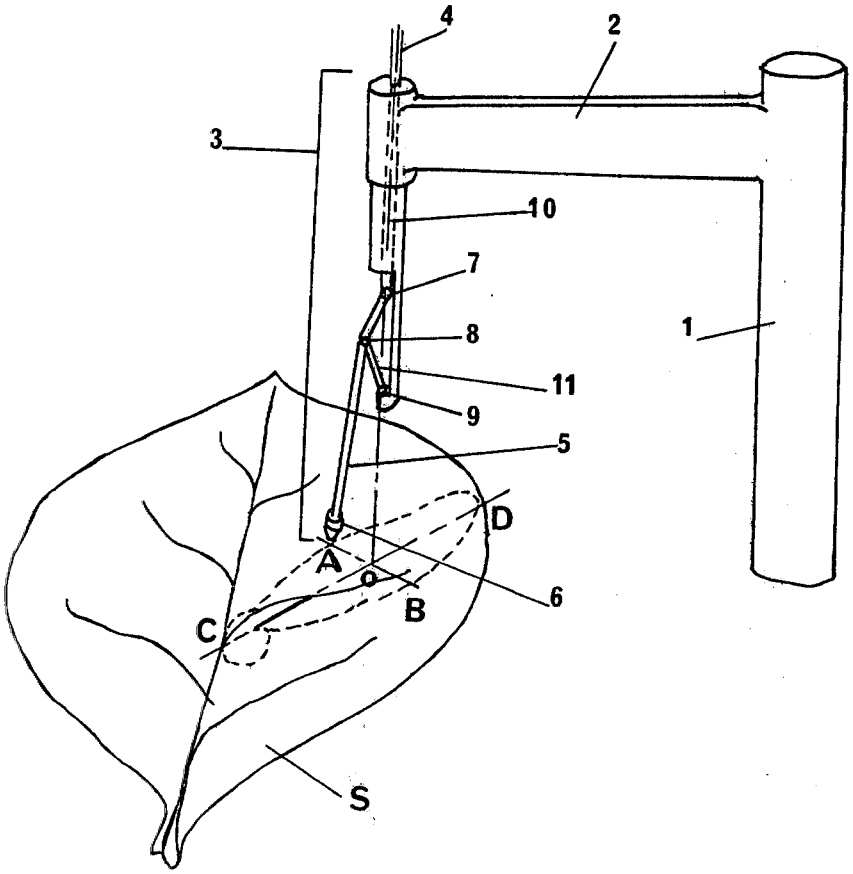
FIG. 2 shows in a more detailed side view an embodiment of an element of FIG. 1.

In FIG. 2, the axis 10 of the cut-out head 3 is centered on the reference point O of the wrapper to be cut out from the leaf S and the nozzle 6 is placed in a starting position for cutting, pointing its end towards point A of the wrapper. The point of reference O corresponds here to the point of intersection of the two main axes, namely the longitudinal and transverse axes, of the wrapper. The starting point for cutting out will preferably be either point A or point B, which is symmetrical thereto with respect to the longitudinal axis, but will always be the same for all cut-outs which are made simultaneously. These two points A and B correspond to the points of intersection of the transverse axis of the wrapper with the contour thereof. The fact of always beginning cut-outs at A or B presents the following advantage: once the axis 10 of the cut-out head 3 of each device is centered at O, which is the centre of the wrapper to cut out from the leaf S, by displacement either of the arm 2 or of the support column 1, the nozzle 6 is placed in starting position simply by rotating the lever 5 about the axis 10, without the nozzle 6 leaving the cylinder defined by a circle of diameter A B and the volume perpendicular to this circle. It can therefore not obstruct the movement of an adjacent nozzle coming into position at the starting point for cutting an adjacent or tangential wrapper.

Figure 3:
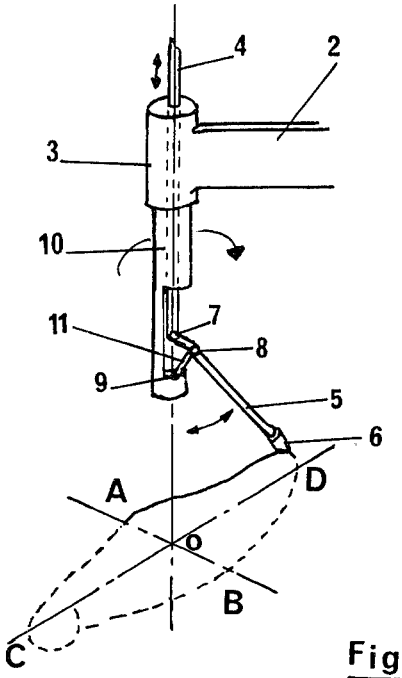
FIG. 3 shows a partial view of FIG. 2.

FIG. 3 shows a partial view of the device when the cut-out operation has already begun. It is very clearly seen that the articulation 7 point of the lever 5 is displaced downwardly along the axis 10 of the cut-out head, so that the distance between the articulation point 7 and point 9 is reduced, thus provoking the pivoting of the connecting rod 11. This causes separation of the nozzle 6 from the centre O of the leaf, while maintaining substantially the same distance between the nozzle and the leaf.

Figure 4:
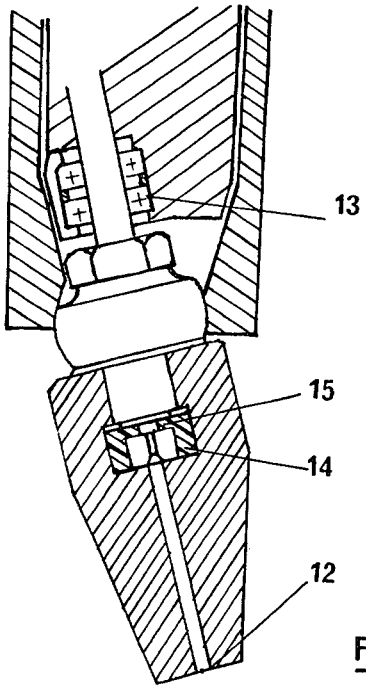
FIG. 4 shows, in section, a partial longitudinal view of the cut-out tool of FIGS. 2 and 3.

FIG. 4 shows a longitudinal section through the nozzle 6. The end 12 of the nozzle is conical, so that the nozzle is totally inscribed within the cylinder having the circle of diameter A B as its directrix.

It may also be seen that the water inlet tube 4 and the nozzle 6 are connected by a ball-bearing system 13. The nozzle may rotate freely when the lever 5 rotates about the axis 10 of the cut-out head; it is maintained by the rigidity of the water inlet tube 4, so that it rotates on itself in a direction contrary to the direction of rotation of the lever about axis 10, thus avoiding the use of rotary joints on the tube 4 which supplies water under very high pressure.

Finally, it may be seen that sapphire 16 is held by a joint 14. This joint will preferably comprise a shoulder 15 in its upper part to ensure an efficient hold of the sapphire when the flow of water passes therethrough.

What we claim is:

1. A process for simultaneously cutting a plurality of wrappers from a leaf or half-leaf of tobacco, said process comprising:

(a) determining the profile of each of said plurality of wrappers to be cut from said leaf or half-leaf;

(b) allocating a cutting tool to each of said wrappers to be cut;

(c) individually positioning each of said cutting tools at a starting point above a respective wrapper profile; and (d) simultaneously displacing said cutting tools along identical paths, whereby a plurality of wrappers will be cut at the same time.

2. A process in accordance with claim 1 wherein each of said wrappers has a longitudinal axis, a transverse axis and a center, and said tobacco has a central rib, wherein individually positioning each of said cutting tools comprises initially positioning each of said tools as a function of the center of each respective wrapper and as a function of the orientation of each respective wrapper with respect to said central rib, the center of each of said wrappers comprising the point of intersection of said transverse axis and said longitudinal axis thereof.

3. A process in accordance with claim 2 wherein individually positioning each of said cutting tools additionally comprises subsequently displacing each tool along a cylinder having a portion of the profile of a respective wrapper as its directrix.

4. A process in accordance with claim 2 wherein each of said starting points comprises a point of intersection of either said transverse axis or said longitudinal axis of each respective wrapper with the profile of each respective wrapper.

5. A process in accordance with claim 1 wherein each tool is identically displaced from a similar starting point selected with respect to respective wrappers so as to cut wrappers of the same sizes and shapes.

* * * * *

UNITED STATES PATENT AND TRADEMARK OFFICE

CERTIFICATE OF CORRECTION

PATENT NO. : 4,311,155

DATED : January 2, 1982

INVENTOR(S) : Jean-Louis DAMERET et al.

It is certified that error appears in the above—identified patent and that said Letters Patent is hereby corrected as shown below:

Column 1, line 51, "realisation" should be --realization--.

Column 1, line 53, "contour" should be --countours--.

Column 2, line 12, "position" should be --positions--.

Column 2, lines 14-15, "individualised" should be --individualized--.

Signed and Sealed this

*Eleventh* Day of *May 1982*

[SEAL]

*Attest:*

GERALD J. MOSSINGHOFF

*Attesting Officer*

*Commissioner of Patents and Trademarks*